US005096001A

United States Patent [19]

Buytaert et al.

[11] Patent Number: 5,096,001

[45] Date of Patent: Mar. 17, 1992

[54] MWD TOOL FOR DEEP, SMALL DIAMETER BOREHOLES

[75] Inventors: Jean P. R. Buytaert, Ploubalay, France; Allen Duckworth, Middlefield, Conn.

[73] Assignee: Teleco Oilfield Services Inc., Meriden, Conn.

[21] Appl. No.: 671,253

[22] Filed: Mar. 18, 1991

[51] Int. Cl.[5] ..... G01V 1/40

[52] U.S. Cl. ..... 175/40; 175/50

[58] Field of Search ..... 175/40, 45–48, 175/50; 166/250, 253–255

[56] References Cited

U.S. PATENT DOCUMENTS

| | | | |
|---|---|---|---|
| 3,790,930 | 2/1974 | Lamel et al. | 175/40 X |
| 3,906,435 | 9/1975 | Lamel et al. | 175/50 X |
| 4,628,495 | 12/1986 | Peppers et al. | 175/40 X |

*Primary Examiner*—Thuy M. Bui

*Attorney, Agent, or Firm*—Fishman, Dionne & Cantor

[57] ABSTRACT

An MWD tool includes a mud pulse generator for operation in an upper section of borehole, a sensor portion for operating close to the drill bit in a deep small diameter section of the borehole and a connector portion running inside the drill pipe for conducting output signals of the sensor portion to the mud pulse generator for subsequent transmission to a receiver at the surface of the borehole.

20 Claims, 1 Drawing Sheet

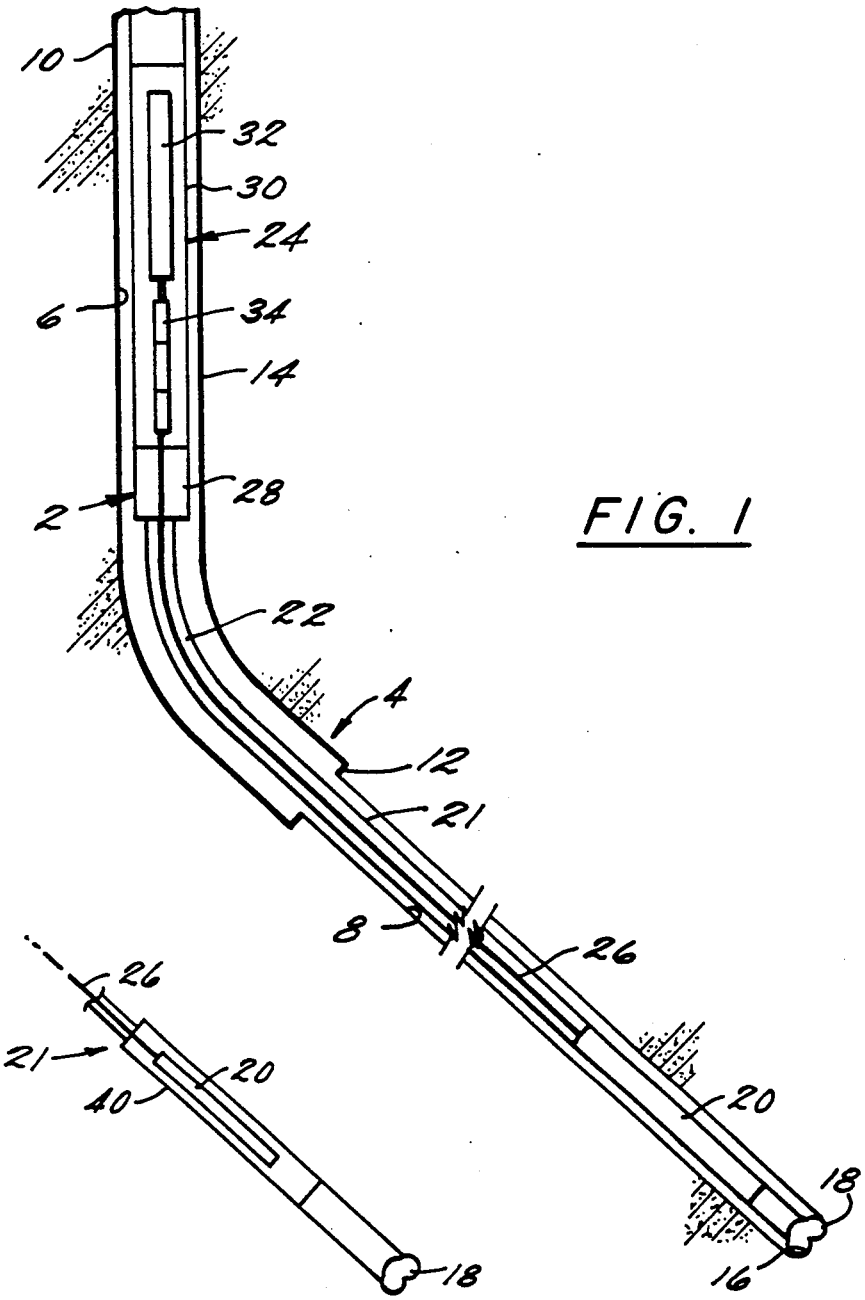
FIG. 1
FIG. 2
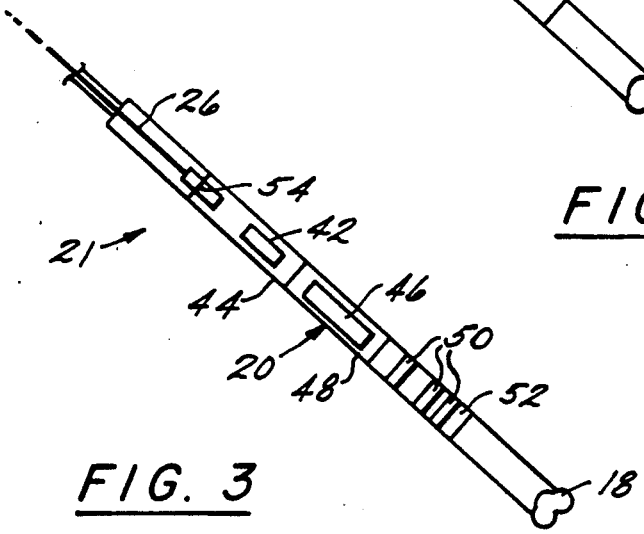
FIG. 3

MWD TOOL FOR DEEP, SMALL DIAMETER BOREHOLES

BACKGROUND OF THE INVENTION

Deep boreholes, e.g., wells for fossil fuel recovery, are conventionally drilled in sections of progressively smaller diameter. As each section is drilled a tubular casing is cemented in place to line and stabilize the borehole. The next section of the borehole must then be drilled in a smaller diameter so that the drill bit is able to pass through the installed casing.

When an MWD tool is used it must be of sufficiently small diameter as to allow it to pass through the last installed, i.e., smallest diameter, section of casing in the borehole and into the section of the borehole being drilled.

However, it becomes more difficult to provide an MWD tool having the required performance characteristics as the maximum allowable diameter decreases. Furthermore, the functional efficiency of an MWD tool may be reduced under the very severe conditions encountered in the lower portion of a deep borehole.

What is needed in the art is an effective reliable MWD survey or logging tool for use in small diameter deep boreholes.

SUMMARY OF THE INVENTION

An apparatus for measuring drilling parameters while drilling a borehole in an earth formation wherein the borehole includes a small diameter deep borehole portion and a large diameter upper borehole portion.

The apparatus includes small diameter drillstring means for drilling the deep borehole portion and sensor means, disposed within the small diameter drillstring means, for measuring drilling parameters characteristic of the deep portion of the borehole while drilling the deep portion of the borehole and for providing sensor output signals indicative of the measured parameters. An upper drillstring portion extends between the surface of the formation and the small diameter drillstring means and includes a large diameter drillstring portion. Data transmission means, disposed within the large drillstring portion and responsive to the sensor output signals, are included for providing a mud pulse output indicative of the sensor output signals. Connector means are provided to conduct the sensor output signal to the transmission means.

BRIEF DESCRIPTION OF THE INVENTION

FIG. 1 shows a schematic longitudinal cross sectional view of an apparatus of the present invention in a borehole.

FIG. 2 shows a preferred embodiment of the apparatus of FIG. 1.

FIG. 3 shows an alternative embodiment of the apparatus of FIG. 1.

DETAILED DESCRIPTION OF THE INVENTION

The FIGURE shows an apparatus 2 of the present invention in a bore hole 4.

The borehole 4 includes an upper borehole portion 6 and a deep borehole portion 8. The upper borehole portion 6 extends from the surface of an earth formation to a bottom end 12 and is lined with a steel casing 14. The deep borehole portion extends from the bottom end 12 of the upper borehole portion to the bottom end of the borehole 16. The upper borehole portion 6 has a substantially uniform upper borehole diameter corresponding to the inner diameter of casing 14. The deep borehole portion has a deep borehole inner diameter corresponding roughly to the transverse dimension of drill bit 18.

The tool 2 of the present invention includes a sensor portion 20, a connector portion 22 and a data transmission portion 24.

The sensor portion 20 is located at the bottom end of the tool 2 within a small diameter drill pipe 21 in close proximity to drill bit 18 and has an outer diameter smaller then the deep borehole diameter so that the sensor portion 20 may be received within the deep portion 8 of the borehole 4. The sensor module 20 includes one or more sensor elements for measuring drilling parameters and providing a sensor output system indicative of the measured parameters. The sensors elements may be any known sensor elements for downhole sensing of drilling parameters. Examples of suitable sensor elements include directional survey sensors, e.g. magnetometers and accelerometers, drillstring sensors, e.g. strain gauges, and formation evaluation sensors, e.g., resistivity sensors, gamma radiation sensors. Exemplary suitable directional survey, drillstring and formation evaluation sensors are described in U.S. Pat. Nos. 4,813,274, 4,958,517 and 4,786,874, respectively, the disclosures of which are each incorporated herein by reference. In a preferred embodiment the sensor module 20 comprises a three axis magnetometer and a three axis accelerometer, i.e. a "steering tool".

In an alternative embodiment, the sensor module 20 comprises both directional and formation evaluation sensors, e.g. a magnetometer, an accelerometer and formation resistivity sensors.

The connector portion 22 connects to the sensor portion 20 with the data transmission portion 24 and includes an armored electrical connector cable 26 and a cable adapter 28 for connecting to cable 26 to the data transmissions portion 24. The cable adapter may be any known electrical connector, e.g., a conventional "side entry sub" combined with a conventional blind entry electronic connector.

The data transmission portion 24 includes a housing 30, a mud pulse generator 32 and an electronics package 34. The housing 30 of the data transmission portion has an outer diameter such that data transmission portion 24 can be safely inserted into the borehole only as far as the bottom end 12 of the upper borehole portion 6, e.g. a outer diameter smaller than the upper borehole diameter but which closely approaches, equals or exceeds the deep borehole diameter. Drillpipe 25 extends from the surface of the formation to the data transmission portion 24 and connects the data transmission portion 24 to mud pulse receiver 27 on the surface of the formation.

Any known mud pulse generator may be used, e.g. those described in U.S. Pat. Nos. 3,693,428 and 3,958,217, the disclosures of which are each incorporated herein by reference. The electronics package 34 includes a battery or generator 35 for providing electrical energy to the mud pulse generator and one or more sensors of sensor portion 20, a controller 36 for controlling the one or more sensors, a microprocessor 37 for formatting sensor output signals for mud pulse transmission by mud pulse generator 32 and a recorder 38 for recording sensor outputs. An exemplary controller is described in U.S. Pat. Nc. 4,021,774 the disclosure of which in incorporated herein by reference.

An embodiment of the present invention wherein the sensor module 20 includes only directional sensors as shown in FIGURE 2. In the embodiment shown in FIG. 2 a conventional nonmagnetic survey collar 40 is placed in the drill string above drill bit. The small diameter drillstring 21 is built up of a small diameter drill collar and drill pipe to a length of longer than the planned length of the next hole sections. Sensor module 20 is then secured to connector means 22 and is lowered into the small diameter drillstring 21 by cable 26 until the sensor module 20 comes to rest in the drill collar 40. The sensor module is provided with an alignment means, e.g. pin and slot, so it is maintained in angular alignment with the drill collar, and rotates with it.

An alternative embodiment wherein sensor module 20 includes both directional sensors 42 and formation evaluation sensors 46, 50 is shown in FIG. 3. In the embodiment of FIG. 3 each of the sensors 42, 46, 50 is built into a drill collar 44, 48, 52 respectively and installed in the drillstring 21. The bottom end of the cable 26 and the top end of collar 44 are each provided with one half of a conventional "wet" connector 54 which makes an electrical connection between the cable 26 and the sensor module 20 when the cable is lowered into the drillstring 21.

In either embodiment, the length of the connector cable 22 is adjusted according to the length of the small diameter drillstring, the cable adapter 28 is secured to the data transmission portion 24 of the tool 2 and the data transmission 24 is installed in the drillstring. The remainder of the drillstring assembly is then made up with drill pipe to a length suitable for drilling.

Significantly, the sensor portion 20 shown in FIG. 2 may be retrieved from the drillstring by removing drill pipe to the point where the data transmission portion 24 comes to the surface and removing the sensor portion 20 from the small diameter drillstring section 21 by means of cable 26. Formation evaluation sensors, if built into one of the drill collars of the small diameter drillstring section 21, would, of course, not be retrievable in this manner.

The tool of the present invention may be used to measure drilling parameters during rotary drilling, in connection with a non-rotary mud motor or with a steerable system which allows either procedure to be used at will.

The sensors may be used either in a real-time mode wherein sensor outputs are conducted from the sensor to the mud pulse generator and transmitted to the receiver at the earth's surface by mud pulse or in a recording mode wherein sensor outputs are stored in a recording module for retrieval when the tool is brought to the surface.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. An apparatus for measuring a drilling parameters while drilling a borehole in an earth formation, wherein the borehole includes a small diameter deep borehole portion and a large diameter upper borehole portion, small diameter drillstring means for drilling the deep borehole portion;

sensor means, disposed within the small diameter drillstring means, for measuring a drilling parameter characteristic of the deep portion of the borehole while drilling the deep portion of the borehole and for providing sensor output signals indicative of the measured parameter;

an upper drillstring portion extending between the surface of the formation and the small diameter drillstring means, said upper drillstring portion including a large diameter drillstring portion;

data transmission means disposed within the large diameter drillstring portion and responsive to said sensor output, for providing a fluid pulse output indicative of the sensor output signal; and connector means for conducting sensor output signals from the sensor to the transmission means.

2. The apparatus of claim 1, further comprising data receiving means, disposed at the surface of the earth formation for receiving the fluid pulse output.

3. The apparatus of claim 1, wherein the deep borehole portion has a deep borehole diameter and the small diameter drillstring means has an outer diameter that is less than the deep borehole diameter.

4. The apparatus of claim 3, wherein upper borehole portion has an upper borehole diameter, the upper borehole diameter is larger than the small borehole diameter and the large diameter drillstring portion has an outer diameter that is greater than the diameter of the small diameter drillstring means and less than the upper borehole diameter.

5. The apparatus of claim 1, wherein the deep borehole has a deep borehole diameter, the upper borehole has an upper borehole diameter, the upper borehole diameter is larger than the deep borehole diameter and the large diameter drillstring portion has an outer diameter that is greater than the deep borehole diameter and less than the upper borehole diameter.

6. The apparatus of CLAIM 1, wherein the sensor means comprises directional survey sensor means for measuring directional parameters.

7. The apparatus of claim 6, wherein the small diameter drillstring means includes a small diameter survey collar and the sensor means is slidably received within and rotatable with the survey collar.

8. The apparatus of claim 6, wherein the sensor means further comprises formation evaluation sensor means for measuring formation parameters.

9. The apparatus of claim 6, wherein the date transmission means further comprises:

control means for controlling operation of the sensor means.

10. The apparatus of claim 1, wherein the connector means comprises an armored electrical cable.

11. The apparatus of claim 1, further comprising memory means for recording the sensor output signal.

12. The apparatus of claim 11, wherein the drilling parameter is direction, weight on bit, torque on bit, natural gamma radiation, formation resistivity, neutron porosity, gamma density, borehole diameter or combinations thereof.

13. The apparatus of claim 12, wherein the data transmission means further comprises:

power supply means for providing electrical power to the sensor means and mud pulse generator.

14. The apparatus of claim 1, wherein the data transmission means comprises a mud pulse generator and microprocessor means for encoding the sensor output signal for mud pulse transmission.

15. The apparatus of claim 1, wherein the sensor means comprises formation evaluation sensor means for measuring formation parameters.

16. The apparatus of claim 15, wherein the small diameter drillstring means includes a small diameter survey collar and the sensor means are rigidly secured to the survey collar.

17. A method for measuring a drillstring parameter during drilling of a borehole in an earth formation comprising:

drilling the deep borehole portion with a drillstring comprising a small diameter drillstring means for drilling the deep borehole portion and large diameter drillstring portion extending between the small diameter drillstring means and the top surface of the formation;

measuring a drilling parameter characteristic of the deep borehole portion while drilling the deep borehole portion using a sensor disposed within the small diameter drillstring means;

providing a sensor output signal indicative of the measured parameter;

electrically conducting the sensor output signal from the sensor to a fluid pulse generator, said generator being disposed with the large diameter drillstring portion;

encoding the sensor output signal for fluid pulse transmission, and transmitting the encoded signal by fluid pulse from the generator to a receiver disposed at the surface of the earth formation.

18. The method of claim 17, wherein the deep borehole portion has a deep borehole diameter and the small diameter drillstring means has an outer diameter that is less than the deep borehole diameter.

19. The method of claim 18, wherein the upper borehole portion has an upper borehole diameter that is greater than the deep borehole diameter and the large diameter drillstring portion has an outer diameter that is greater than the diameter of the small diameter drillstring means and less than the upper borehole diameter.

20. The method of claim 17, wherein the drilling parameter is direction, weight on bit, torque on bit, natural gamma radiation, formation resistivity, neutron porosity, gamma density, borehole diameter or combinations thereof.

* * * * *

UNITED STATES PATENT AND TRADEMARK OFFICE

CERTIFICATE OF CORRECTION

PATENT NO. : 5,096,001

DATED : March 17, 1992

INVENTORS : Jean P. R. Buytaert et al.

It is certified that error appears in the above-identified patent and that said Letters Patent is hereby corrected as shown below:

Col. 1, line 50: Delete "INVENTION" and insert therefor --DRAWINGS--.

Col. 4, line 48: Delete "date" and insert therefor --data--.

Signed and Sealed this

First Day of February, 1994

Bruce Lehman

*Attest:*

BRUCE LEHMAN

*Attesting Officer*

*Commissioner of Patents and Trademarks*